US010064446B2

(12) United States Patent
Möhlmann et al.

(10) Patent No.: US 10,064,446 B2
(45) Date of Patent: Sep. 4, 2018

(54) SHOE HAVING AN AIR PUMP DEVICE WITH A SPRING ELEMENT CLASPING A BELLOWS

(71) Applicant: ATMOS airwalk ag, Zürich Glattbrugg (CH)

(72) Inventors: Wilhelm Möhlmann, Glattbrugg Zürich (CH); Jens Schmidt, Obersimten Rheinland-Pfalz (DE)

(73) Assignee: ATMOS airwalk ag, Zürich Glattbrugg (CH)

( * ) Notice: Subject to any disclaimer, the term of this patent is extended or adjusted under 35 U.S.C. 154(b) by 0 days.

(21) Appl. No.: 15/581,042

(22) Filed: Apr. 28, 2017

(65) Prior Publication Data

US 2018/0192734 A1 Jul. 12, 2018

(30) Foreign Application Priority Data

Jan. 9, 2017 (EP) ..... 17150718

(51) Int. Cl.
*A43B 7/06* (2006.01)
*A43B 1/10* (2006.01)
(Continued)

(52) U.S. Cl.
CPC ..... *A43B 7/081* (2013.01); *A43B 7/082* (2013.01); *A43B 13/18* (2013.01); *A43B 13/20* (2013.01);
(Continued)

(58) Field of Classification Search
CPC ..... A43B 7/081; A43B 7/082; A43B 7/08; A43B 13/20; A43B 13/203; A43B 5/06;
(Continued)

(56) References Cited

U.S. PATENT DOCUMENTS 1,364,226 A * 1/1921 Wherry ..... A43B 7/06 36/147
1,403,970 A * 1/1922 Lioy ..... A43B 21/32 36/3 B
(Continued)

OTHER PUBLICATIONS

European Search Report and Opinion issued in European Application No. 17150718.9 dated May 4, 2017 Jan. 4, 2016(German).

*Primary Examiner* — Katharine Gracz
(74) *Attorney, Agent, or Firm* — Parker Highlander PLLC

(57) ABSTRACT

A shoe has an air pump device for blowing air into the interior of a shoe comprising a bellows formed in the sole structure and surrounding a cavity, an intake channel for transporting air from an intake opening into the bellows, an air supply device formed in the sole structure for forwarding air from the bellows into the interior of the shoe, and a V-shaped or U-shaped spring element which clasps the bellows. An upper leg of the spring element comprises an upper pressure plate arranged above the bellows and below an insole of the sole structure, and a lower leg comprises a lower pressure plate arranged under the bellows and above an outsole layer, so that a connecting section that connects the two legs is arranged beside the bellows in the sole structure. The air pump device is arranged in such manner that when the sole structure is placed under load during a walking movement, the spring element is deformed elastically by pressing the pressure plates together, wherein the deformation takes place substantially at or close to the connecting section, so that the pressure plates substantially keep their shape, and the bellows is compressed.

6 Claims, 4 Drawing Sheets

(51) Int. Cl.
*A43B 7/08* (2006.01)
*A43B 13/20* (2006.01)
*A43B 13/18* (2006.01)

(52) U.S. Cl.
CPC ..... *A43B 13/203* (2013.01); *A43B 7/08* (2013.01); *A43B 13/183* (2013.01); *A43B 13/185* (2013.01)

(58) Field of Classification Search
CPC ..... A43B 7/005; A43B 7/105; A43B 13/18; A43B 13/183; A43B 13/185
USPC ..... 36/102, 129, 3 B, 3 R, 27
See application file for complete search history.

(56) References Cited

U.S. PATENT DOCUMENTS 2,329,573 A * 9/1943 Ziegliss ..... A43B 7/06 36/147
2,354,407 A * 7/1944 Shaks ..... A43B 7/06 36/147
3,029,530 A 4/1962 Eaton
3,180,039 A 4/1965 Burns et al.
3,973,336 A * 8/1976 Ah ..... A43B 7/081 36/3 B
4,610,099 A * 9/1986 Signori ..... A43B 13/203 36/28
4,760,651 A * 8/1988 Pon-Tzu ..... A43B 7/06 36/138
5,502,901 A * 4/1996 Brown ..... A43B 1/0018 36/27
5,628,128 A 5/1997 Miller et al.
5,655,315 A * 8/1997 Mershon ..... A43B 1/0018 36/29
5,797,199 A 8/1998 Miller et al.
5,975,861 A * 11/1999 Shin ..... A43B 7/081 36/29
6,029,374 A 2/2000 Herr et al.
6,044,577 A * 4/2000 Clark ..... A43B 7/081 36/29
6,928,756 B1 * 8/2005 Haynes ..... A43B 13/183 36/27
2004/0016144 A1 * 1/2004 Gallegos ..... A43B 7/081 36/3 R
2004/0068891 A1 * 4/2004 Wang ..... A43B 1/0018 36/27
2005/0016021 A1 * 1/2005 Marvin ..... A43B 13/14 36/29
2005/0102857 A1 * 5/2005 Yen ..... A43B 3/0052 36/28
2006/0032083 A1 * 2/2006 Lim ..... A43B 7/082 36/3 B
2010/0139127 A1 * 6/2010 Huang ..... A43B 1/0018 36/3 B
2011/0131839 A1 * 6/2011 Ballin ..... A43B 13/186 36/141
2012/0110871 A1 * 5/2012 Elnekaveh ..... A43B 1/0054 36/87
2013/0118028 A1 * 5/2013 Yoon ..... A43B 13/143 36/27
2014/0013632 A1 * 1/2014 Mohlmann ..... A43B 7/081 36/25 R
2015/0040435 A1 2/2015 Barnes et al.

* cited by examiner

SHOE HAVING AN AIR PUMP DEVICE WITH A SPRING ELEMENT CLASPING A BELLOWS

CROSS-REFERENCE TO RELATED APPLICATIONS

This application claims priority to European Patent Application No. 17 150 718.9, filed Jan. 9, 2017 the entire contents of which are incorporated herein by reference.

BACKGROUND INFORMATION

The invention relates to a shoe having a sole structure and an air pump device for blowing air into the interior of the shoe, the air pump device comprising a bellows made from an elastic plastic material, formed in the sole structure and surrounding a cavity, an intake channel for transporting air from an intake opening into the bellows, and an air supply device formed in the sole structure for forwarding air from the bellows into the interior of the shoe.

Such a shoe is known for example from the documents EP 2 218 348 A1 and WO 2012/126489 A1. In the known shoes of the kind described above, the sole structure may have a multilayer construction in the heel area, wherein an intermediate layer containing the cavity is made from a material (soft polyurethane foam for example) that is intended to be more elastic or more compressible than the material of the outsole. The cavity and the compressible plastic layers that surround it form a bellows. The air pump device is designed so that, in an alternating manner in response to a walking movement of a user, air is sucked into the cavity of the bellows from outside the shoe via the air intake channel when a load is removed (the shoe is lifted off the ground) and air is blown out of the bellows into the shoe interior through channels of an air supply device when a load is applied (when the shoe comes into contact with the ground and supports the user's weight). A first valve is arranged in the air intake channel and is designed to allow air to pass only in the direction from outside the sole structure into the cavity. A second valve is arranged in the air supply device, and is designed to allow air to pass only in the direction from the cavity to the channels. The pump effect is supported further still by the outsole having a raised area in the region of the bellows on the outer tread, which area is pressed toward the upper part of the sole when the load of the user's foot is placed upon it. The teaching of EP 2 218 348 A1 includes the suggestion to arrange the intermediate sole between a hard outsole and a further sole, wherein the intermediate sole should be manufactured from a material that is more compressible (more elastic/softer) than that of the outsole and the further sole.

In order to achieve good ventilation of the shoe interior, that is to say effective airflow, it is essential that during walking at each step, on the one hand, a sufficiently large quantity of air is sucked into the bellows from the outside and on the other hand that it is then blown out of the bellows into the shoe interior. In order for the greatest possible quantity of air to be blown into the shoe interior when the load is applied during each step, not only must the volume of the bellows be maximized; it must also be ensured that when the load is applied, the bellows is compressed almost completely, or at least to a great degree, so that the air contained is forced out. Complete or substantial compression can be achieved by making the sole structure surrounding the cavity very supple or soft, so that it is completely compressed by the effect of the bodyweight. However, the bellows must also expand and fill with air as completely as possible thereafter, when the user lifts the foot with the shoe, and before the next treading (in the next step). Such a restoring action is achieved with a sole material surrounding the cavity that is as elastically hard as possible. However, this conflicts with the previously stated requirement for a soft material.

In order to support the restoration of the bellows, from EP 1 093 729 A1 and EP 0 624 322 A1 for example, it is known to arrange helical springs vertically inside the cavity in such manner that they are compressed when the bellows is compressed. These constructions are expensive to make, they require a relatively large installation space, and in shoes that are exposed to heavy use they have a short service life.

SUMMARY

In the light of the considerations, it is an object of the invention to create a shoe having a sole structure and an air pump device for blowing air into the interior of the shoe that enables the greatest possible airflow during each step of a walking or running motion together with a long service life even when the shoe is subjected to heavy use (as is particularly the case with running shoes).

According to the invention, this object is solved by a shoe having the features of claim 1.

In a shoe according to the invention with a sole structure and at least one air pump device for blowing air into the interior of the shoe, the air pump device (or at least one of the air pump devices, respectively) comprises a bellows made from an elastic plastic material formed in the sole structure and surrounds a cavity, an intake channel for transporting air into the bellows from an intake opening, and an air supply device formed in the sole structure for forwarding air from the bellows into the interior of the shoe. In some embodiments, the intake channel and/or the air supply device may comprise several conduits (e.g., tubes or pipes) operating in parallel. On the other hand, in some embodiments the intake channel and the air supply device may comprise a common duct section which opens into the cavity. Preferably, the intake channel and the air supply device comprise one-way valves to ensure the desired direction of air transport. Here, the term "bellows" is intended to denote the function of a device that completely surrounds a volume of air (except for openings for the intake channel and the air supply device) and which expresses air through at least one opening when the bellows is compressed and sucks air in when the bellows expands. For example, the bellows may be formed solely by the walls of the cavity or by a bladder fitted inside the cavity (made from a soft, elastic plastic, for example). The (or at least one) air pump device in the shoe according to the invention further comprises a V-shaped or U-shaped spring element that clasps the bellows. An upper leg of the V-shaped or U-shaped spring element comprises an upper pressure plate arranged over the bellows and under an insole of the sole structure, and a lower leg of the V-shaped or U-shaped spring element comprises a lower pressure plate arranged under the bellows and over an outsole layer of the sole structure, a joining section of the spring element coupling the two legs being arranged beside the bellows in the sole structure. The term "V-shaped or U-shaped spring element" is not to be interpreted here in limiting manner, meaning that the legs should always be exactly the same length and straight; they may also be of different lengths or slightly curved. An arrangement "over an outsole layer" should here also include an arrangement over one of a plurality of outsole layers or inside one outsole layer. The air pump device (or any of multiple air pump devices) is arranged such that the V-shaped or U-shaped spring element is deformed elastically by pressing the pressure plates together during a walking motion when the sole structure is loaded by the weight of the shoe wearer, the deformation taking place substantially at or close to the coupling section, so the pressure plates above and below the at least one bellows substantially keep their shape, and the bellows arranged between the pressure plates is compressed. The air pump device (or each of the air pump devices) with bellows, intake channel, air supply device and spring element is thus embedded in the sole structure (in preferred exemplary embodiments except for a portion of the intake channel, which is routed out of the sole structure, preferably in or along the upper, upward to one or more intake openings). This sole structure, in which the air pump device (or each of the air pump devices) is embedded, may be produced from a single plastic material, for example. However, the sole structure preferably has a multilayer construction. This multilayer construction preferably comprises at least one insole, at least one intermediate layer made from a compressible material (intermediate sole) containing the bellows and the spring element, and at least one outsole layer arranged below it. Consequently, the term "insole" is intended here to refer to any uppermost sole layer between the shoe interior and the upper pressure plate. In some embodiments, the insole may have a multilayer construction. For functional purposes, the insole in this case should be considered as part of the sole structure, although it is usually part of the upper for the purposes of shoemaking. The coupling of the insole to the upper may be made by any means (e.g., lasted, cement lasted, Strobel construction, Goodyear welting or double stitching). The intermediate layer (intermediate sole) and the outsole layer are preferably made of different materials (each of which is adapted to its various functions), but in one embodiment they may also be manufactured from the same material.

The solution according to the invention provides a shoe that enables a high airflow rate during each step of a walking or running motion and a long service life even with heavy use (as occurs particularly with running shoes). The solution according to the invention not only ensures that the bellows regains its shape faster and more completely during expansion; it also supports the bellows compression due to the expansive distribution of the compressive force by the upper and lower pressure plates, which substantially retain their shape when pressed together.

The shoe preferably has a single air pump device. The bellows of the air pump device is arranged in the heel area of the shoe, and the V- or U-shaped spring element extends substantially over the entire heel area. The coupling section is thus arranged in a joint area of the shoe and/or in a peripheral area of the heel area adjacent to the joint area This preferred arrangement of the bellows with the spring element clasping it enables a high pumping capacity and at the same time cushions the running motion and absorbs impact when the heel area comes into contact with the ground, particularly in a running shoe.

A preferred embodiment is characterized in that a support section is formed on the coupling section in the opposite direction to the legs, so that the spring element is Y-shaped, wherein the support section protrudes into the joint area of the shoe to no more than about 10 mm in front of a ball-of-the-foot area in the forefoot area. This stabilizes the position of the spring element in the sole structure and spreads the forces exerted on the adjacent sole material at the leading edge of the spring element when the spring element is deformed, so that the sole material is exposed to lower loads and the shoe therefore remains serviceable for longer.

In a preferred further development, at least one stabilizer spring element (preferably one stabilizer spring element each) is arranged next to the bellows on both sides. Each of the stabilizer spring elements is coupled to lateral peripheral areas of the upper and lower pressure plates in such a manner that said elements are compressed elastically when the pressure plates are pressed together, wherein the elasticity of the stabilizer spring elements arranged on both sides of the shoe is adjusted (dimensioned) such that they are pressed together to approximately the same degree when load on the sole structure due to the weight of the wearer during a running motion causes them to be pressed together, which has the effect of counteracting a rotation of the upper pressure plate with respect to the lower pressure plate about an axis parallel to the lengthwise direction of the shoe. This stabilizes the position of the foot during the compression of the sole structure in the heel area that takes place when a wearer is running and reduces the danger of turning the ankle to the side (distortion). Due to the fact that the force acting on the stabilizer spring element(s) arranged on the outer side of the shoe may differ from the force acting on the stabilizer spring element(s) arranged on the inner side of the shoe, the elastic properties of the stabilizer spring element(s) located on both sides of the shoe should be set differently. The required (different) elastic properties of the outer and inner stabilizer spring elements may be calculated on the basis of models or determined experimentally.

Preferably, each of the stabilizer spring elements is coupled in torsion-resistant manner to lateral peripheral areas of the upper and lower pressure plates in such a manner that a relative movement of the upper and lower pressure plates in the lateral directions is prevented or at least impeded. This too helps to further stabilize the position of the foot. In a preferred embodiment, the stabilizer spring elements arranged on both sides of the bellows are coupled to each other via a bridge arranged on the rear edge of the heel area. This stabilizes the torsion-resistant coupling with the lateral peripheral areas.

The stabilizer spring elements preferably each comprise at least one V-shaped or U-shaped spring section, which is arranged in such manner that the legs thereof move closer to one another when the stabilizer spring elements are compressed. In a simple embodiment, each of the stabilizer spring elements may only consist of one V- or U-shaped spring element, of which the upper leg is coupled to the upper pressure plate and the lower leg is coupled to the lower pressure plate. Other embodiments may comprise bridges arranged in the manner of a grid in a vertical plane, multiple pairs of such bridges or bridge sections each forming V- or U-shaped spring elements.

In one exemplary embodiment, the lateral peripheral areas of the upper and lower pressure plates, to which the stabilizer spring elements are coupled, form bearing surfaces for respective upper and lower ends of the stabilizer spring elements. The ends of the stabilizer spring elements in contact with these peripheral areas have corresponding bearing surfaces which are permanently attached by adhesion or some other means to the bearing surfaces of the peripheral areas of the pressure plates.

The peripheral areas arranged on both sides of the lower pressure plate are preferably each separated from the middle area of the lower pressure plate located below the bellows by a gap or slit which is open towards the back side of the shoe, so that both peripheral areas of the lower pressure plate form separate spring legs. The middle area of the lower pressure plate located between the two gaps projects downward, so that the pressing together of the bearing surfaces and therefore of the stabilizer spring elements does not begin until after the middle area of the lower pressure plate and the upper pressure plate have been pressed together by a predetermined distance. This makes it possible for a part of the bellows volume to be compressed even without the effect of the stabilizer spring elements so that the bellows volume can be partially increased at the expense of some stabilizing effect. The optimum between a bellows volume to be maximized (significant projection of the middle area) and an adequate stabilization of the foot (early actuation of the effect of the spring elements due to a small projection of the middle area) may be calculated on the basis of models or determined experimentally.

A preferred embodiment is characterized in that the stabilizer spring elements are fastened detachably or replaceably. In a further preferred embodiment, the stabilizer spring elements comprise a device for adjusting the spring force. Both embodiments enable an adjustment to the bodyweight of the shoe wearer.

An advantageous further development of the shoe according to the invention is characterized in that folds are formed in the side walls of the bellows on the open sides of the V- or U-shaped spring elements. The precise arrangement of these folds enables the nature of the deformation of the bellows to be defined when it is compressed with a low wall thickness, which in turn allows a larger bellows volume.

The shoe according to the invention is preferably characterized in that the intake channel coupled to the bellows for transporting air from an intake opening to the bellows has a minimum cross sectional area of 3 $mm^2$, for shoe sizes longer than about 25 cm, a minimum cross sectional area of 4 $mm^2$. This minimum cross section ensures a lower flow resistance when the air is sucked in, and thus contributes to a faster, and accordingly (given the restoring time limited by the time taken for a step) largely complete restoration when the bellows expands. In this context, the intake opening is preferably spanned by a dirt-repellent mesh (e.g., plastic mesh or net) and has a larger minimum area than the minimum cross sectional area of the intake channel to compensate for the greater flow resistance caused by the dirt-repellent mesh.

Advantageous and/or preferred further developments of the invention are characterized in the subordinate claims.

In the following, the invention will be explained in greater detail with reference to preferred exemplary embodiments represented in the drawings. In the drawings.

Figure 8A:
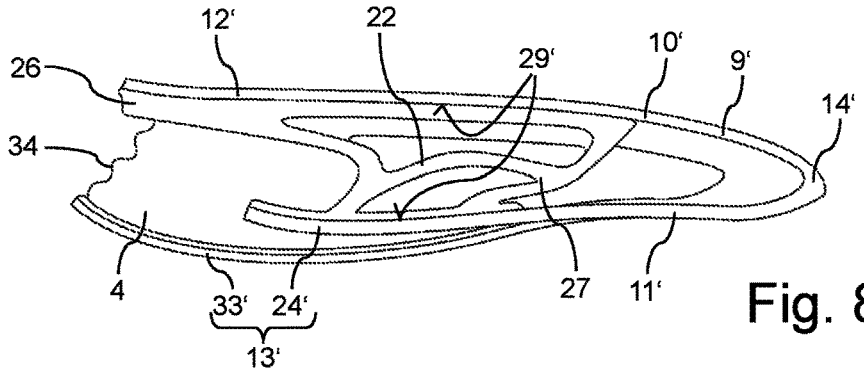
Figure 8B:
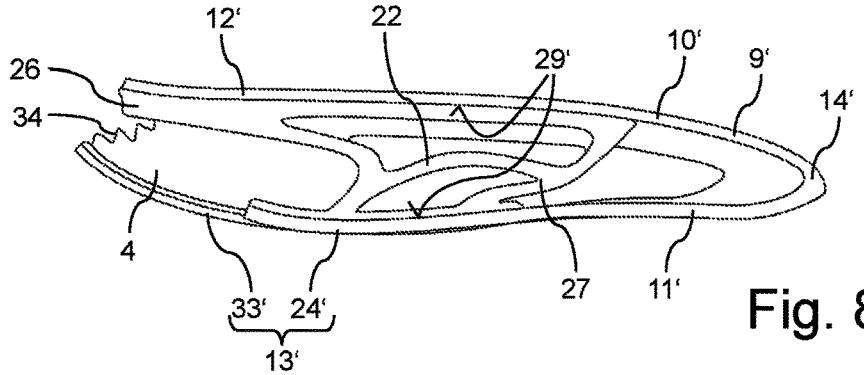
Figure 8C:
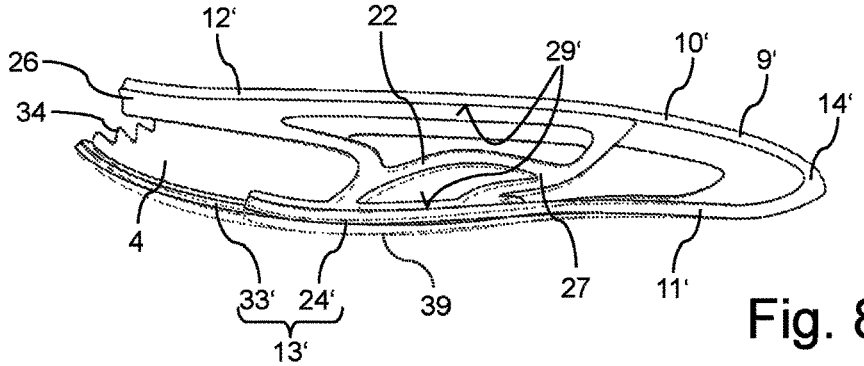
Figure 9:
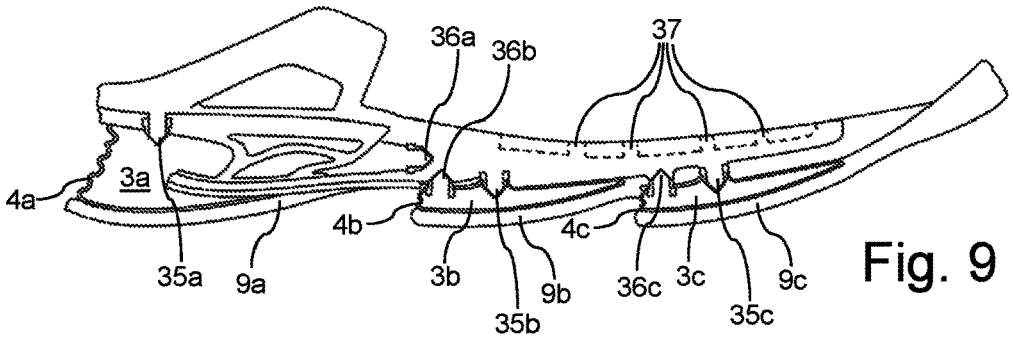

FIGS. 8A to 8C are diagrammatic side views of an air pump device with a bellows, a V-shaped spring element and stabilizer spring elements arranged on both sides of the bellows in various load phases during a walking motion to illustrate the compression of the bellows and of the initiation of the compression of the stabilizer spring elements; and FIG. 9 is a diagrammatic side view of an alternative embodiment with three air pump devices, which may be arranged in the heel area, in the joint area and in the forefoot area of the shoe.

Figure 1:
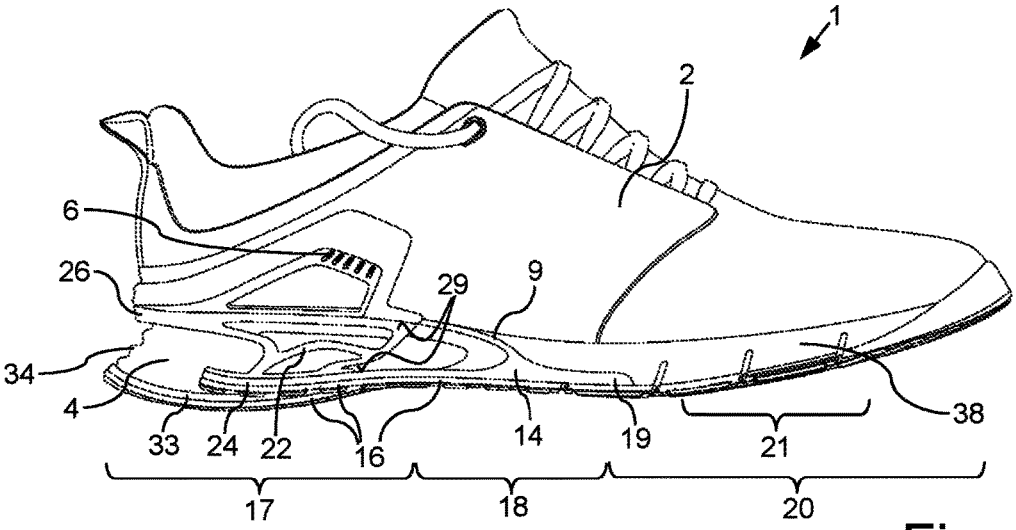
FIG. 1 is a diagrammatic view of an inner side of a shoe according to the invention.
Figure 2:
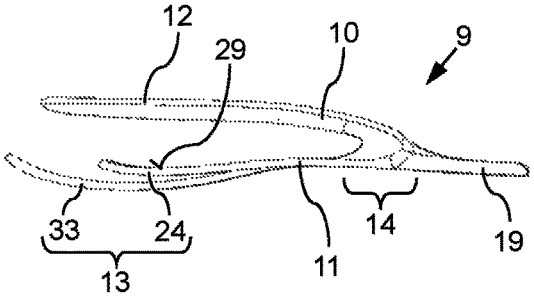
FIG. 2 is a separate view of the spring element clasping the bellows contained in the shoe according to FIG. 1.
Figure 3:
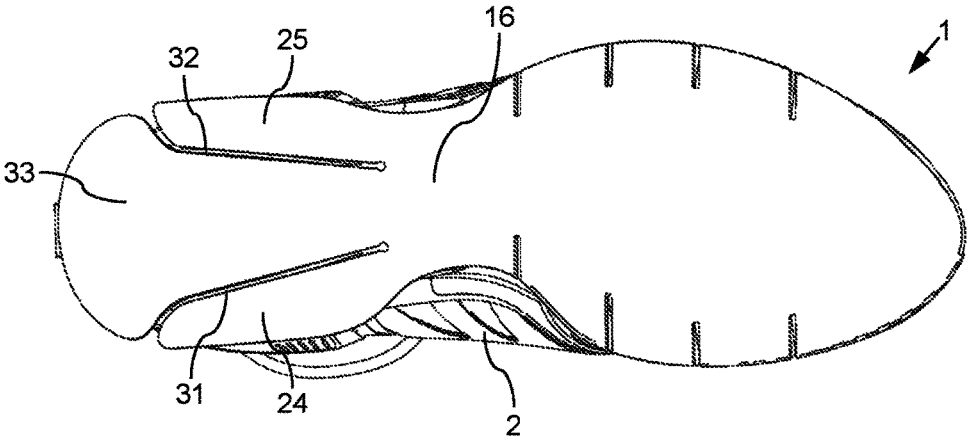
FIG. 3 is a bottom view of the shoe according to FIG. 1.
Figure 4:
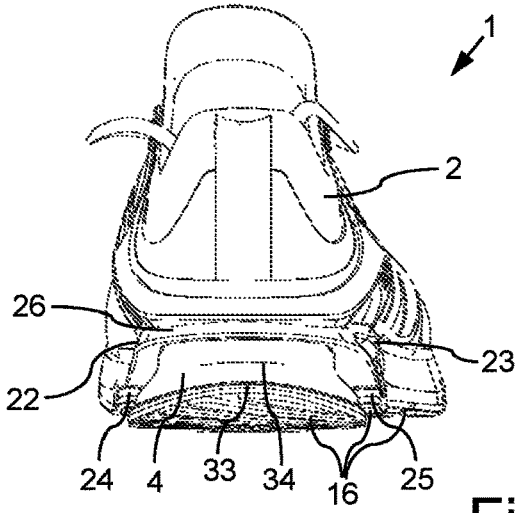
FIG. 4 is a rear view of the shoe according to FIG. 1.

A first preferred exemplary embodiment of the shoe 1 according to the invention is shown in FIGS. 1 to 4. FIG. 1 shows a diagrammatic side view of the inner side, FIG. 3 shows a view of the underside and FIG. 4 shows a rear view of shoe 1. FIG. 2 shows a separate view of the spring element 9 contained in the shoe and clasping the bellows. Shoe 1 comprises a sole structure and an upper 2, an air pump device being provided for blowing fresh air into the interior of shoe 1. The fresh air is preferably sucked in from outside the shoe 1, but—in an exemplary embodiment not shown here—it may also be sucked in at a location away from the sole on the inner side of upper 2. The air is preferably blown out through openings in the upper layer or layers of the sole structure, preferably in the forefoot or the toes. Except for the section of the intake channel adjacent to an intake opening 6, the components of the air pump device are arranged inside the sole structure.

The air pump device of the shoe 1 shown in FIGS. 1, 3 and 4 comprises a bellows 4 surrounding a cavity, made from an elastic plastic material, which is fitted in a heel area 17 of shoe 1. The cavity surrounded by the plastic wall of bellows 4 extends substantially over the entire length and most of the width of heel area 17.

Bellows 4 is clasped by a V-shaped spring element 9, which in the embodiment shown here is Y-shaped (see FIG. 2; the Y shape is considered as being a variant of the V-shape). The V-shaped spring element 9 has an upper leg 10 and a lower leg 11, which are connected to each other and to a support section 19 at a connecting section 14. The position of the V-shaped spring element 9 inside the sole structure of shoe 1 is shown in FIG. 1. Upper leg 10 of V-shaped spring element 9 comprises an upper pressure plate 12 arranged over bellows 4. An insole (not shown in FIGS. 1 to 4) is arranged over upper pressure plate 12. Additional sole layers may also be arranged above the upper pressure plate and over the entire V-shaped spring element 9, for example intermediate layers may be arranged between the V-shaped spring element 9 and the insole or cover layers over the insole. Lower leg 11 comprises a lower pressure plate 13, arranged below bellows 4 and above an outsole layer 16. In this context, outsole layer 16 may lie directly against the underside of V-shaped spring element 9. However, in another embodiment, lower leg 11 of V-shaped spring element 9 may be embedded completely in an intermediate sole layer, and the outsole layer would then be applied to this underside of this intermediate layer. In yet another exemplary embodiment, lower leg 11 of V-shaped spring element 9 may also be embedded completely in the material of an outsole layer 16.

As is particularly evident in FIG. 3, lower pressure plate 13 of lower leg 11 is divided into three areas, each separated from each other by a slit or gap, the three areas being a middle area 33, a peripheral area 24 arranged on the inner side of the shoe and separated from middle area 33 by slit or gap 31, and a peripheral area 25 arranged on the outer side of shoe 1, and separated from middle area 33 by gap 32. Bellows 4 is situated essentially between middle area 33 of lower pressure plate 13 and upper pressure plate 12. A first stabilizer spring element 22 is arranged between peripheral area 24 of the lower pressure plate 13 and a peripheral area of upper pressure plate 12 arranged above it. A second stabilizer spring element 23 is arranged between peripheral area 25 of the lower pressure plate 13 and the peripheral area of upper pressure plate 12 arranged above it. The stabilizer spring elements 22 and 23 have bearing surfaces on the underside thereof which are attached, by adhesion for example, to corresponding bearing surfaces 29 of peripheral areas 24 and 25. The upper sides of stabilizer spring elements 22, 23 are fastened to the peripheral areas of upper pressure plate 12. The two stabilizer spring elements 22 and 23 are fastened to the rear side of the shoe by means of a bridge 26.

As is shown in FIG. 1, stabilizer spring elements 22, 23 have V-shaped or U-shaped spring sections 27, the legs of which move closer to each other when stabilizer spring elements 22, 23 are compressed vertically. Stabilizer spring elements 22, 23 counteract the compression with a predetermined force that corresponds to their elasticity. The elasticities of the stabilizer spring elements 22, 23 arranged on both sides of the shoe are adjusted in such manner that the stabilizer spring elements 22, 23 are pressed together approximately equally in the squeezing action when the sole structure is loaded by the weight of the wearer of shoe 1 during a running movement, so that a rotation of the upper pressure plate 12 with respect to the lower pressure plate 13 about an axis parallel to the lengthwise direction of shoe 1 is counteracted. In addition, each of the stabilizer spring elements 22, 23 is connected in a torsion-proof manner to the associated lateral peripheral areas 24, 25 of lower pressure plate 13 and to the corresponding peripheral areas of upper pressure plate 12 in such manner that a relative movement of the upper and lower pressure plates in the lateral direction is prevented or at least impeded. Stabilization of the position of stabilizer spring elements 22, 23 is also assisted by the afore-mentioned rear bridge connection 26. The compression of the stabilizer spring elements under load is illustrated more clearly in FIG. 8C, and will be explained in greater detail below.

As is shown in FIGS. 1 and 2, middle area 33 of lower pressure plate 13 protrudes downward with respect to peripheral areas 24 and 25. The result of this is that when heel area 17 is exposed to a load, initially only middle area 33 of lower pressure plate 13 is loaded, causing it to be pressed toward upper pressure plate 12 and causing bellows 4 to be compressed. Then, when the middle area has been pressed upward until it lies flush with peripheral areas 24 and 25, subsequently all three areas 24, 33, 25 are pressed toward upper pressure plate 12. This will be explained in greater detail in conjunction with FIGS. 8A to 8C.

The V-shaped spring element 9 has a connecting section 14 which connects upper leg 10 and lower leg 11 to each other. The V-shaped spring element 9 is deformed by pressing together pressure plates 13 and 12, this deformation taking place essentially at connecting section 14 or in those areas of legs 10 and 11 that are located close to connecting section 14. In this process, the pressure plates substantially retain their shape, so that pressure plates 12 and 13 press against the upper side and the underside of the bellows over the largest area possible. Pressure plates 12 and 13 should not be deformed in those areas where they act on the upper side or underside of bellows 4 in such a manner that bellows 4 can no longer be pressed together over the entire horizontal extension thereof. In particular, a pointwise pressing-in of pressure plates 12 and 13 should be avoided. The V-shaped spring element 9 also has a support section 19 which serves to brace and stabilize the position of the V-shaped spring element 9 inside a sole structure, particularly inside a soft intermediate layer of the sole structure. As may be seen in FIG. 1, connecting section 14 is located within the joint area 18 of the shoe and support section 19 extends toward forefoot area 20, ending approximately 1 cm before the ball-of-the-foot area 21. The provision of support section 19 serves to reduce the load on the sole material from the active forces originating from the V-shaped spring element 9, so that the service life of the sole structure is increased.

The V-shaped spring element 9 is produced from an elastically resilient material, an elastic plastic material, for example, particularly a thermoplastic elastic material such as a fiber-reinforced polyamide (e.g., nylon) or a polyether block amide (e.g., VESTAMID or PEBAX). In a preferred embodiment, the V-shaped spring element is made from a carbon fiber reinforced composite material. The plastic bladder that surrounds the cavity of bellows 4 is manufactured from a polypropylene or a polyurethane for example. The air pump device with bellows, V-shaped spring element 9, air supply device and intake channel is preferably embedded in a supple elastic (compressible) plastic material of an intermediate layer of the sole structure (intermediate sole 38). The outsole layer 16 attached to the underside of the shoe is made from an abrasion-resistant plastic material. The materials of bellows 4, V-shaped spring element 9 and the intermediate layer of the sole structure and outsole layer 16 are matched to each other and connected to each other in such manner that the materials are hardly detached at all at the boundary surfaces thereof, even under heavy, continuous load. The distribution of forces produced in this process, particularly at spring element 9 is assured by the aforesaid support section 19.

Besides the bellows 4, the air pump device comprises an intake channel for transporting air from an intake opening 6 into bellows 4 and an air supply device formed in the sole structure for forwarding air from bellows 4 into the interior of shoe 1. These channels are not shown in FIGS. 1, 3 and 4. Only in FIG. 1, intake opening 6 arranged above the sole structure on upper 2 of shoe 1 is discernible. This higher arrangement of intake opening 6 relative to the sole serves to reduce the likelihood of dirt and water being sucked up from the running surface. In addition, intake opening 6 is covered with a mesh, outlined in FIG. 1, which serves to repel dirt particles.

To manufacture the sole structure with air pump device, first for example a plastic bladder of bellows 4 (also called "lung") is produced, and this is then inserted between upper leg 10 and lower leg 11 of spring element 9, whereby the stabilizer spring elements are also fastened. Then the entire assembly is overmolded with a soft elastic plastic material (thereby forming an intermediate sole 38), after which the further components of the sole (e.g., outsole layer) may also be overmolded and the upper may be attached adhesively to the insole. Alternatively, a prefabricated air pump device assembled from bellows, intake channel, air supply device, V- or U-shaped spring element and stabilizer spring elements may also be glued together or joined in some other way with a prefabricated intermediate sole or a plurality of prefabricated intermediate sole parts, which may then be followed by attaching the outsole layer and the upper to the insole.

Figure 5:
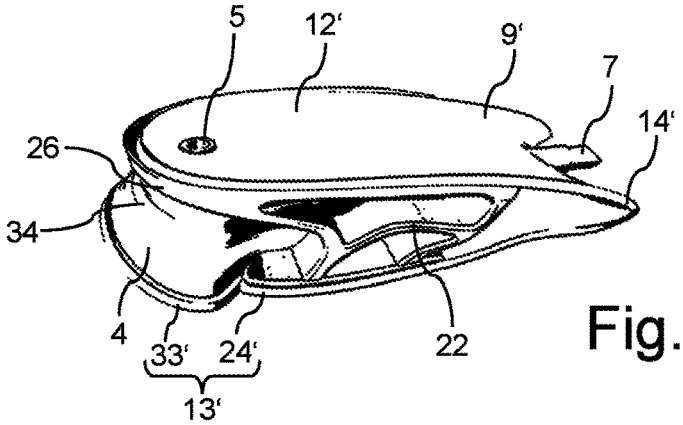
FIG. 5 is a perspective view of an alternative embodiment of a bellows, a V-shaped spring element and stabilizer spring elements of an air pump device arranged on both sides of the bellows.
Figure 6:
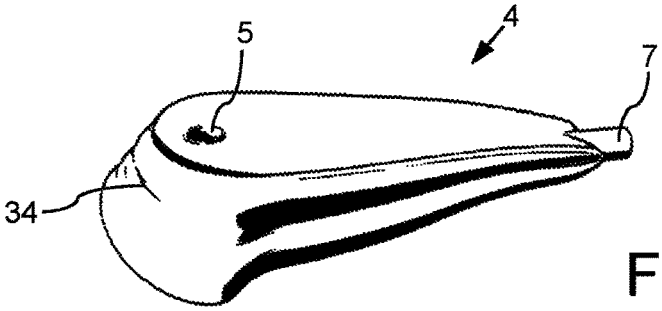
FIG. 6 is a separate view of the bellows according to FIG. 5.

FIGS. 5 and 6 are diagrammatic representations of an alternative embodiment of the essential components of the air pump device, namely a bellows 4 (shown separately in FIG. 6), an alternative embodiment of the V-shaped spring element 9' and stabilizer spring elements 22 arranged between the legs of spring element 9. In this embodiment of the V-shaped spring element 9', the support section attached to the end of connecting section 14' is omitted. Bellows 4 has an opening on the top side thereof which is part of intake channel 5, and on its front side a channel which is part of air supply device 7. FIG. 5 shows that the channel of the air supply device 7 is routed through an opening in connecting section 14' of the V-shaped spring element 9'. Upper pressure plate 12' of spring element 9' also has a drill hole through which intake channel 5 is routed. The exposed side walls of bellows 4 between upper pressure plate 12' and middle area 33' of lower pressure plate 13' have folds 34 with which it is possible to precisely define the deformation during compression when the walls of bellows 4 are not thick.

Figure 7A:
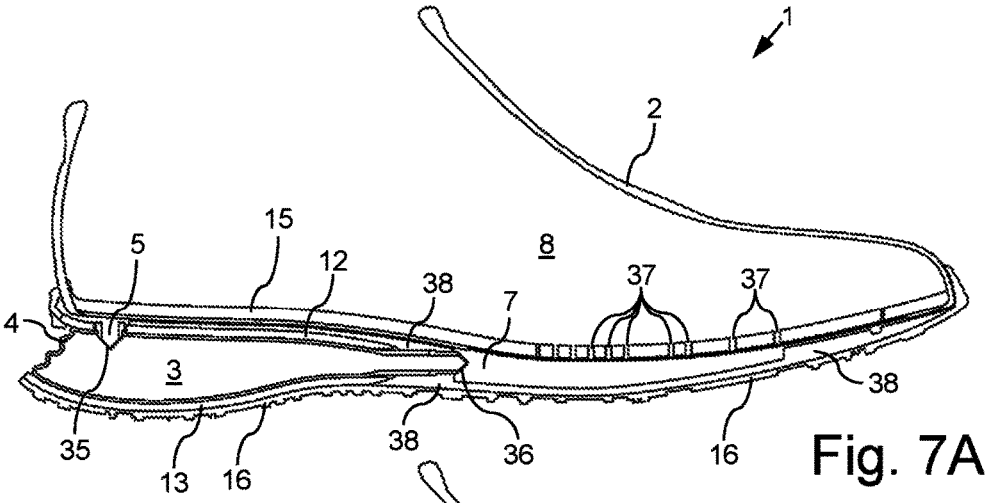
FIGS. 7A to 7C are diagrammatic cross sectional views of a shoe according to the invention in various load phases during a walking motion to illustrate the air pump function.
Figure 7B:
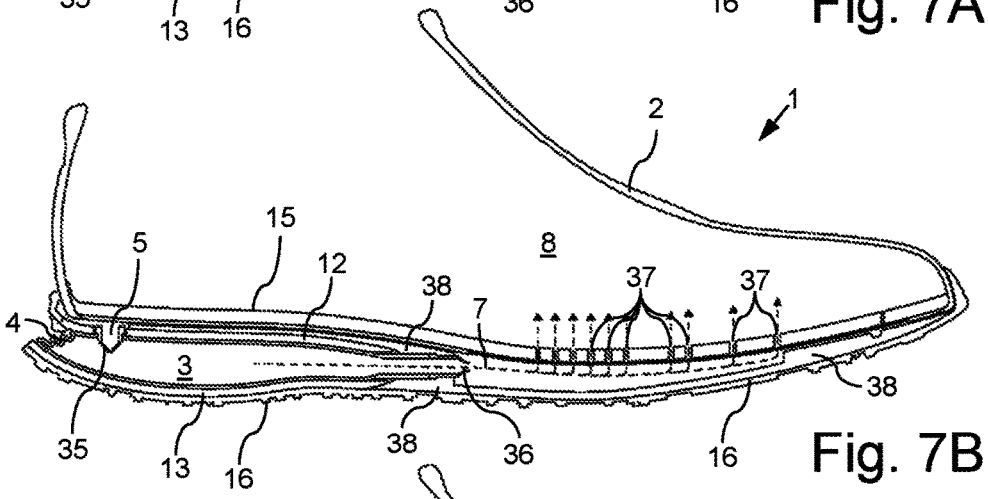
Figure 7C:
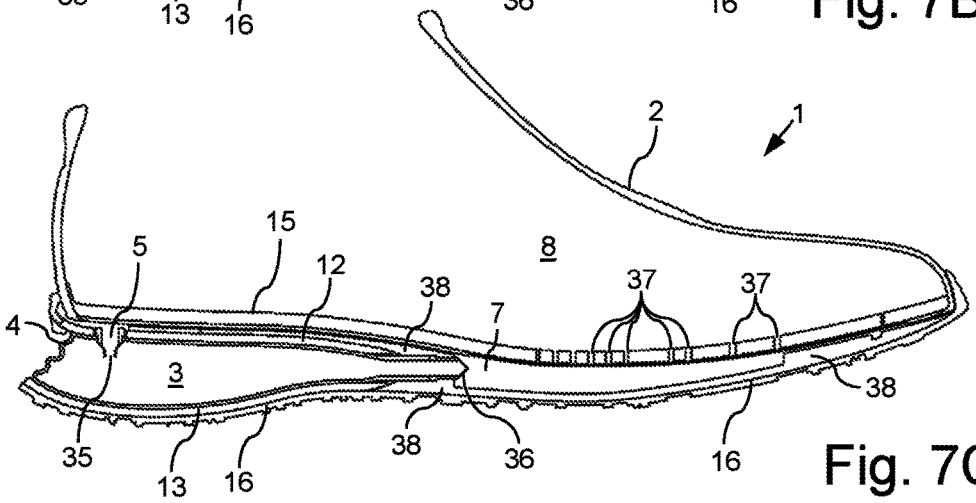

The air pumping function in the shoe 1 according to the invention is explained in greater detail with reference to FIGS. 7A to 7C. FIGS. 7A to 7C show diagrammatic cross sections lengthwise along the central axis of a shoe.

FIG. 7A shows the shoe under no load. Bellows 4 surrounding cavity 3, is fully expanded. The diagrammatically represented one-way inlet valve 35 of intake channel 5 is closed. The diagrammatically represented one-way outlet valve 36 in air supply device 7 is also closed. Air supply device 7 extends from the opening of bellows 4, which is closed by one-way valve 36, through a cavity or channel inside the intermediate layer 38 in the sole, and ends below openings 37 in insole 15.

FIG. 7B shows the shoe in a heel area load state in which bellows 4 is compressed. When bellows 4 is compressed, cavity 3 is compressed, which causes the pressure in cavity 3 to rise. This keeps one-way inlet valve 35 closed, but opens one-way outlet valve 36, whereupon air from cavity 3 flows through the one-way valve 36 into the channels arranged in intermediate layer 38, and continues from there through the openings 37 in insole 15 and into the interior 8 inside upper 2 of the shoe. The dashed arrows indicated the flow of air. FIG. 7B thus shows the state in which air is blown out into interior 8 of the shoe.

When the load is then removed from the heel area, the state according to FIG. 7C is reached. FIG. 7C illustrates the expansion of bellows 4 due to its intrinsic restoring forces, but mainly due to the restoring forces exerted by V-shaped spring element 9, i.e. due to the restoration of upper pressure plate 12 and lower pressure plate 13 to their original positions. At the same time, cavity 3 of bellows 4 becomes larger, creating a low pressure (or underpressure) in cavity 3. As a result of this underpressure, one-way outlet valve 36 of air supply device 7 closes and one-way inlet valve 35 in intake channel 5 opens, as is shown diagrammatically in FIG. 7C. Intake channel 5 is routed upward along the rear side of the shoe between sole structure and upper 2, and has an intake opening 6, not shown in FIG. 7C, through which fresh air is sucked in from the outside.

During normal running movements, the states shown in FIG. 7C and FIG. 7B alternate, so that when the foot is placed in contact with the ground in each step, air is pumped out of cavity 3 in bellows 4, through air supply device 7 into interior 8 of the shoe, and every time the foot is lifted off the ground and the load is removed from the heel area, air is sucked in from the outside through intake channel 5 by bellows 4.

FIGS. 8A to 8C illustrate three phases of the deformation of the air pump device, particularly of V-shaped spring element 9, bellows 4 and stabilizer spring elements 22, 23 during a running movement.

First, FIG. 8A shows the state under no load, in which bellows 4 is fully expanded. Bellows 4 is positioned between upper pressure plate 12' of upper leg 10' and the middle area 33' of lower pressure plate 13' of lower leg 11' of the V-shaped spring element 9'. The middle area 33' of lower pressure plate 13' projects downward with respect to the peripheral area 24' of lower pressure plate 13'.

After the shoe wearer places his weight on the foot, first the middle area 33' of lower pressure plate 13' is moved upward, causing bellows 4 to be compressed, with the result that—as explained with reference to FIGS. 7A to 7C—air is expelled from bellows 4 into the interior 8 of the shoe. After the middle area 33' has been pressed to the level of the peripheral area 24', as shown in FIG. 8B, the application of further loading to the shoe has the effect of pressing lower pressure plate 13' further toward upper pressure plate 12'. The further deformation with respect to the state of FIG. 8B is shown in FIG. 8C by dotted lines 39. FIG. 8C shows the subsequent deformation of stabilizer spring element 22.

Preferred embodiments of the shoe according to the invention have been described with reference to FIGS. 1 to 8C, in which bellows 4 with the V-shaped spring element 9; 9' that clasps it is located in heel area 17 of shoe 1. Alternative embodiments are also conceivable, in which further air pump devices with respective bellows devices and V-shaped spring elements may be arranged in the sole alternatively or additionally. This is illustrated in the diagrammatic representation of FIG. 9, which represents a sole structure with three air pump devices in the heel area, in the joint area and in the forefoot area. FIG. 9 shows a bellows 4*a* with associated spring element 9*a* surrounding a cavity 3*a*. One-way valves 35*a* and 36*a* of the intake channel and air supply device respectively are also represented diagrammatically. FIG. 9 further shows a bellows 4*b* arranged in the joint area, surrounding a cavity 3*b* and clasped by a spring element 9*b*. Finally, a third bellows 4*c* surrounding cavity 3*c* and clasped by spring element 9*c* is also represented. FIG. 9 also shows openings 37 in the insole, through which the air expressed from cavities 3*a*, 3*b* and 3*c* passes into the interior of the shoe. FIG. 9 does not show the intake channels 5 ending respectively at one-way inlet valves 35*a*, 35*b* and 35*c* and the air supply devices between one-way outlet valves 36*a*, 36*b* and 36*c* and openings 37.

Many alternative embodiments are conceivable within the scope of the inventive idea. For example, the division of the lower pressure plate 13 of the V- or U-shaped spring elements 9 into a middle area 33 acting on bellows 4 and two peripheral areas 24 and 25 acting on the stabilizer spring elements may also be omitted, in which case stabilizer spring elements 22, 23 may be constructed in such a manner that they initially counteract a compression with a relatively low force in a first portion of the compression path, and this force increases steadily as the compression proceeds. The V- or U-shaped spring element 9 may comprise multiple different material layers. In other exemplary embodiments, spring element 9 and stabilizer spring elements 22 and 23 may also be constructed as a single part.

Although the invention has been described in detail with reference to certain preferred embodiments, variations and modifications exist within the scope and spirit of the invention as defined in the following claims.

The invention claimed is:

1. A shoe having a sole structure and at least one air pump device for blowing air into an interior of the shoe, said air pump device comprising:

a bellows made from an elastic plastic material, formed in the sole structure and surrounding a cavity, an intake channel for transporting air from an intake opening into the bellows, and an air supply device formed in the sole structure for forwarding air from the bellows into the interior of the shoe, said air pump device comprising a V-shaped or U-shaped spring element which clasps the bellows, an upper leg of the spring element comprising an upper pressure plate arranged above the bellows and below an insole of the sole structure, and a lower leg of the spring element comprising a lower pressure plate arranged under the bellows and above an outsole layer of the sole structure, so that a connecting section of the spring element that connects to the two legs is arranged beside the bellows in the sole structure, and said air pump device being arranged in such a manner that when the sole structure is placed under load by the weight of the wearer of the shoe during a walking movement, the spring element is deformed elastically by pressing the pressure plates together, wherein the deformation takes place substantially at or close to the connecting section, so that the pressure plates above and below the bellows substantially keep their shape, and the bellows arranged between the pressure plates is compressed, wherein the bellows of the air pump device is arranged in a heel area of the shoe, and the spring element extends substantially over the entire area of the heel area, wherein the connecting section is arranged in a joint area of the shoe and/or in an peripheral area of the heel area adjacent to the joint area, wherein at least one stabilizer spring element is arranged on both sides of the bellows, wherein each of the stabilizer spring elements is connected to lateral peripheral areas of the upper and lower pressure plates in such a manner that it can be compressed elastically when the pressure plates are pressed together, wherein a support section is formed on the connecting section in the opposite direction to the legs, so that the spring element is Y-shaped, wherein the support section protrudes into the joint area of the shoe to no more than about 10 mm before reaching a ball-of-the-foot area within a forefoot area, wherein the lateral peripheral areas of the upper and lower pressure plates, to which the stabilizer spring elements are connected, form bearing surfaces for respective upper and lower ends of the stabilizer spring elements, and wherein the elasticity of the stabilizer spring elements arranged on both sides of the shoe is adjusted such that they are pressed together to approximately the same degree when load on the sole structure due to the weight of the wearer of the shoe during a running motion causes them to be pressed together, which has the effect of counteracting a rotation of the upper pressure plate with respect to the lower pressure plate about an axis parallel to the lengthwise direction of the shoe, wherein the peripheral areas arranged on both sides of the lower pressure plate are each separated from a middle area of the lower pressure plate located below the bellows by a gap which is open towards the back side of the shoe, so that both peripheral areas of the lower pressure plate form separate spring legs, and wherein the middle area of the lower pressure plate projects downwards, so that the pressing together of the bearing surfaces and therewith of the stabilizer spring elements as well does not begin until after the middle area of the lower pressure plate and the upper pressure plate have been pressed together by a predetermined distance.

2. The shoe according to claim 1, wherein the stabilizer spring elements are fastened detachably or replaceably.

3. The shoe according to claim 1, wherein folds are formed in the side walls of the bellows on the open sides of the spring element.

4. A shoe having a sole structure and at least one air pump device for blowing air into an interior of the shoe, said air pump device comprising:

a bellows made from an elastic plastic material, formed in the sole structure and surrounding a cavity, an intake channel for transporting air from an intake opening into the bellows, and an air supply device formed in the sole structure for forwarding air from the bellows into the interior of the shoe, said air pump device comprising a V-shaped or U-shaped spring element which clasps the bellows, an upper leg of the spring element comprising an upper pressure plate arranged above the bellows and below an insole of the sole structure, and a lower leg of the spring element comprising a lower pressure plate arranged under the bellows and above an outsole layer of the sole structure, so that a connecting section of the spring element that connects to the two legs is arranged beside the bellows in the sole structure, and said air pump device being arranged in such a manner that when the sole structure is placed under load by the weight of the wearer of the shoe during a walking movement, the spring element is deformed elastically by pressing the pressure plates together, wherein the deformation takes place substantially at or close to the connecting section, so that the pressure plates above and below the bellows substantially keep their shape, and the bellows arranged between the pressure plates is compressed, wherein the bellows of the air pump device is arranged in a heel area of the shoe, and the spring element extends substantially over the entire area of the heel area, wherein the connecting section is arranged in a joint area of the shoe and/or in an peripheral area of the heel area adjacent to the joint area, wherein at least one stabilizer spring element is arranged on both sides of the bellows, wherein each of the stabilizer spring elements is connected to lateral peripheral areas of the upper and lower pressure plates in such a manner that it can be compressed elastically when the pressure plates are pressed together, and wherein the elasticity of the stabilizer spring elements arranged on both sides of the shoe is adjusted such that they are pressed together to approximately the same degree when load on the sole structure due to the weight of the wearer of the shoe during a running motion causes them to be pressed together, which has the effect of counteracting a rotation of the upper pressure plate with respect to the lower pressure plate about an axis parallel to the lengthwise direction of the shoe, wherein the lateral peripheral areas of the upper and lower pressure plates, to which the stabilizer spring elements are connected, form bearing surfaces for respective upper and lower ends of the stabilizer spring elements, and wherein the peripheral areas arranged on both sides of the lower pressure plate are each separated from a middle area of the lower pressure plate located below the bellows by a gap which is open towards the back side of the shoe, so that both peripheral areas of the lower pressure plate form separate spring legs, and wherein the middle area of the lower pressure plate projects downwards, so that the pressing together of the bearing surfaces and therewith of the stabilizer spring elements as well does not begin until after the middle area of the lower pressure plate and the upper pressure plate have been pressed together by a predetermined distance.

5. The shoe according to claim 4, wherein the stabilizer spring elements are fastened detachably or replaceably.

6. The shoe according to claim 4, wherein folds are formed in the side walls of the bellows on the open sides of the spring element.

* * * * *